343-909

6/9/81 XR 4,272,770 SR

United States Patent [19]

Miller et al.

[11] 4,272,770

[45] Jun. 9, 1981

[54] REFLECTOR ANTENNAE APPARATUS FOR LIMITING APERTURE BLOCKAGE

[75] Inventors: Coleman J. Miller, Arnold; Daniel Davis, Baltimore, both of Md.

[73] Assignee: Westinghouse Electric Corp., Pittsburgh, Pa.

[21] Appl. No.: 93,323

[22] Filed: Nov. 13, 1979

[51] Int. Cl.[3] ..... H01Q 15/10; H01Q 19/13

[52] U.S. Cl. ..... 343/782; 343/909

[58] Field of Search ..... 343/782, 840, 909, 786

[56] References Cited

U.S. PATENT DOCUMENTS 2,808,586 10/1957 Ehrlich et al. ..... 343/909

3,231,892 1/1966 Matson et al. ..... 343/909

4,131,896 12/1978 Miller ..... 343/909

FOREIGN PATENT DOCUMENTS 1111603 7/1958 France ..... 343/782

*Primary Examiner*—Eli Lieberman

*Attorney, Agent, or Firm*—H. W. Patterson

[57] ABSTRACT

A reflector antennae assembly for reducing aperture blockage that includes an etched printed circuit board mounted on the sidewalls of a blocking structure. The board has spaced conductive squares or circles on one plane surface that is parallel to the direction of propagation and E-field of the reflected wave energy.

11 Claims, 7 Drawing Figures

FIG.3
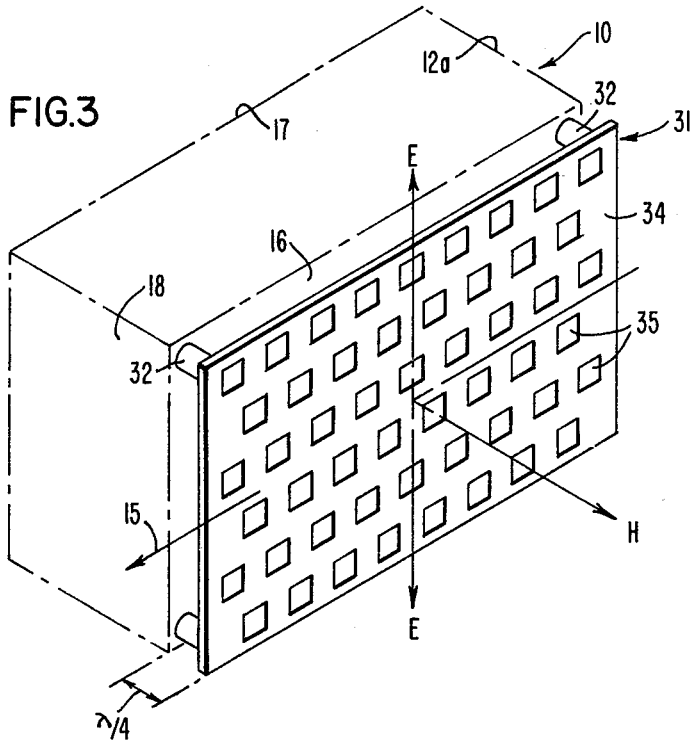
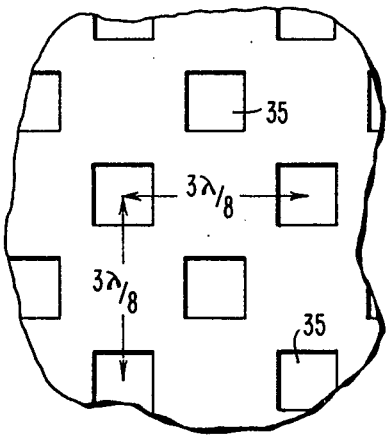
FIG.4
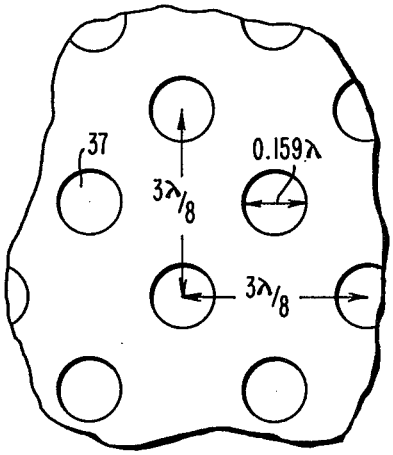
FIG.5

REFLECTOR ANTENNAE APPARATUS FOR LIMITING APERTURE BLOCKAGE

GOVERNMENT CONTRACT

The government has rights in this invention pursuant to Contract No. F 19628-78-C-0177 awarded by the Department of the Air Force.

BACKGROUND OF THE INVENTION

The present invention relates to reflector antennae apparatus and more particularly to apparatus for minimizing the effect of aperture blockage.

In antennae systems where the radiant energy is transmitted by one or more feedhorns toward a reflecting surface, the energy reflected by such surface is partially blocked by the feedhorn structure; and may be blocked, in many instances, by other structures that are in the path of the reflected wave energy. Such blocking is commonly referred to as aperture blocking; and is an important factor in the increase of sidelobe level, as well as the reduction of gain, and the sharpening of the beam. Although aperture blocking occurs in various well-known geometrically shaped antennae reflectors, such blocking is more serious in the well known parabolic cylinder type reflector. Such parabolic cylinder reflector type antennae offers certain advantages over other type reflectors in that they can be fed not only by a point source but by a line source feed that may take many forms, such as linear arrays of dipoles of waveguide slots, for example.

In reflector type antennae, it is the customary practice to decrease to the extent feasible the surface area of the feed structure facing the reflecting surface; and of course, to minimize the presence and size of any other structure in the path of the reflected waves. However, for antennae systems that include a number of feedhorns, or in line feed sources, the surface area facing the reflector may be relatively small but have a considerable dimension that is parallel to the reflected waves, which is referred to herein as the depth of the blocking structure. Further, since multiple feedhorns are utilized, the angles of incidence of the reflected waves differs in accordance with the particular feedhorn that is radiating the energy.

Heretofore, one of the joint inventors herein, namely Coleman J. Miller, proposed an assembly for reducing the effect of feed blockage in a parabolic cylinder reflector antennae wherein an etched circuit board or structure having a plurality of spaced exposed conductive plates in the form of elongated rectangles was secured to the feedhorn structure in a position such that the exposed surface of the circuit board lay in a plane parallel to the direction of the reflected waves. The conductive rectangles were arranged in rows with the bottom edge of the rectangles of one row being coincident with the top edge of an adjacent row. The rows were staggered so that each conductive rectangle of one row was positioned intermediate adjacent rectangles of the next row. Such conductive rectangles had a dimension of approximately 0.0826 wavelengths in the direction of the reflected waves, and a dimension of 0.165 wavelengths in the direction of the E-field. The conductive rectangles of each staggered row were spaced apart center to center in the dielectric surface or in other words in the direction of wave propagation 0.3304 wavelengths. The perimeters of each such conductive rectangles measured approximately 0.5 wavelengths.

Although structures such as previously described provided improvement in the sidelobes, their effectiveness decreased for different angles of incidence of reflection. Also, it was necessary to manufacture and assemble such boards for positioning in the proper direction relative to the reflected wave; that is, with a narrow portion of the exposed rectangular conductive portions extending in the plane or direction of reflection of the wave, with the longer dimension of the rectangle parallel to the E-plane of the reflected wave.

Thus, it is desirable to provide an improved assembly for limiting the effect of aperture blockage to reduce the sidelobes; and yet permit versatility in assembly and manufacture while effectively reducing such blockage for all angles of incidence of the reflected waves.

SUMMARY OF THE INVENTION

In accordance with the present invention, an etched circuit board having a plurality of spaced exposed metallic portions on one plane surface thereof is mounted to cover those surfaces of a blocking structure, such that the plane of the exposed surfaces of the spaced metallic plates lies in a plane parallel to the direction of the reflected waves and the E-field. Each of the plurality of the exposed conductive portions is configured such that any two perpendicular lines dividing the conductive portion into quadrants are of equal length. The perimeter of such metallic portions are approximately 0.5 wavelengths. Each of the conductive portions are disposed in staggered rows with the conductive portions of one row being intermediate the conductive portions of the adjacent row. The distance from the center of one conductive portion to the center of its adjacent conductive portion in the same row is approximately $\frac{3}{8}$ of a wavelength, and the distance from the center of one conductive portion to the center of its aligned conductive portion in alternate rows is approximately $\frac{3}{8}$ of a wavelength.

In one particular aspect of the present invention, the plurality of spaced metallic portions are each substantially square in configuration; and in another particular aspect such spaced metallic portions are substantially circular in configuration.

BRIEF DESCRIPTION OF THE DRAWINGS

FIG. 3 is an isometric view of an etched circuit board constructed according to one embodiment of the invention in assembled relationship to a typical blocking structure;

FIG. 4 is a fragmentary view of an etched circuit board according to the embodiment of the invention of FIG. 3;

FIG. 5 is a fragmentary view of an etched circuit board according to another embodiment of the present invention;

DESCRIPTION OF THE PREFERRED EMBODIMENTS

Figure 1:
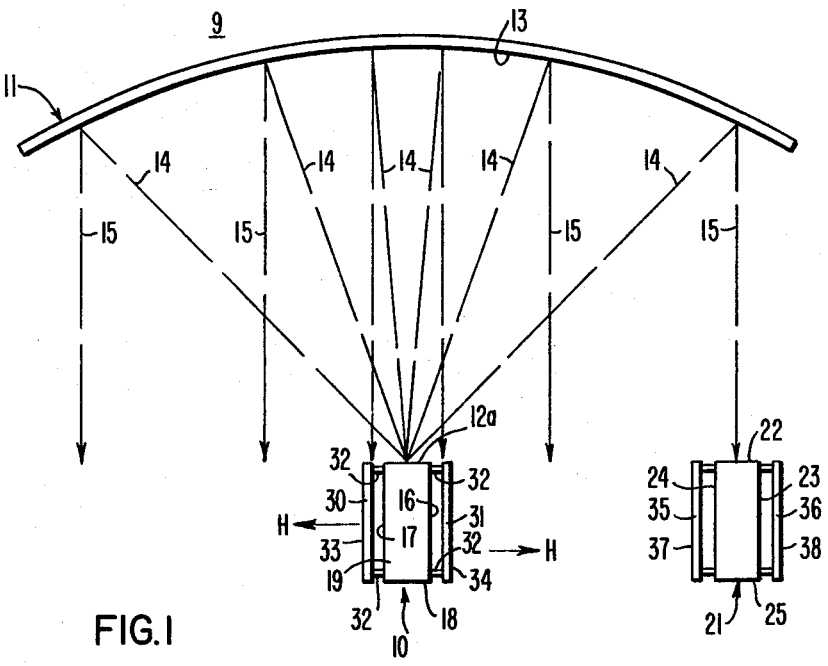
FIG. 1 is a diagrammatic repesentation of an antennae assembly having a parabolic cylinder type reflector illustrating etched circuit boards according to the present invention assembled in a position on a typical aperture blocking structure.
Figure 2:
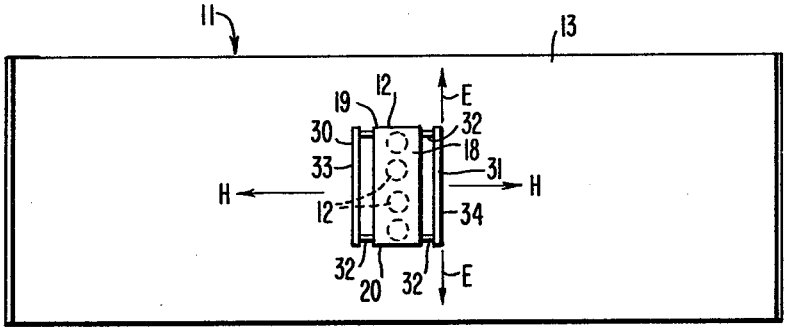
FIG. 2 is a diagrammatic representation of the antennae assembly looking toward the reflecting surface of the reflector of FIG. 1.

Referring to FIGS. 1 and 2, a reflector type antennae assembly generally referred to as 9 includes a feedhorn structure 10 and a parabolic cylinder type reflector 11. Radiant energy is transmitted from one or more of a plurality of feeds 12 in a front portion 12*a* of the feedhorn structure toward face 13 of the reflector 11 in paths noted by dashed lines 14. The energy is reflected from the parabolic cylinder surface 13 in a direction designated by dashed lines 15. The feedhorn structure 10 typically has opposite sidewalls referred to as 16 and 17 respectively, and of course, a rear wall 18 opposite the front surface or feed aperture 12*a* which faces the reflecting surface 13. The length of the sidewalls 16 and 17 extending in a direction away from the reflector 12 determines the depth of the feedhorn structure. The sidewalls 16 and 17 are parallel to the reflected waveforms 15, and in some cases it may be necessary to add new sidewalls walls 16 and 17 to the existing structure to ensure this. The distance between the sidewalls 16 and 17 at the feed aperture 12 of the feed structure 11 is referred to as the width of the feedhorn structure 10. Surface 19 is referred to as the top of the feedhorn structure 10 and surface 20 is referred to as the bottom of such structure. The distance between the top surface 19 and the bottom surface 20 is referred to herein as the heighth of the feedhorn structure. Also, shown diagrammatically in FIG. 1 (not shown in FIG. 2) is a structure 21 which may be any sort of a mounting or supporting structure which obstructs partially the path 15 of the reflected waves. The structure 21 has a front surface 22 that faces the reflecting surface 13 of the reflector 12, sidewalls 23 and 24 that are substantially parallel to the path 15 of the reflected waves and a rear wall or surface 25. The distance between the sidewalls 23 and 24 at the front surface 22 is referred to as the width of the structure and the distance between the front surface 22 and the rear surface 25 is referred to as the depth of the structure.

In operation, the structure 10 and a structure such as 21, which are in the path 15 of the reflected waves, cause what is generally known as aperture blockage. This blockage is caused by the reflected waves striking the front surface 12*a* of the feedhorn structure 11 and/or front surface 22 of a structure such as 21. The amount of feed blockage, and thus the amplitude of the sidelobes, is dependent upon the area of the front surface 12*a* of the structure 11 and/or the front surface 22 of a blocking structure such as 21. In addition, the amount of feed blockage also depends on the depth of the structure 11 or 21. For every reflected waveform there are fields set up, which are well known. Each of these fields has a certain direction relative to the path 15 of the reflected waves. The E-field of the waveform has a direction substantially perpendicular to the paths 15 in a direction noted by the arrows referred to at E. The H field has a direction substantially perpendicular to the direction of the E-field and perpendicular to the paths 15 of the reflected waveform and is noted by the direction of arrows H. In accordance with the present invention, circuit boards referred to at 30 and 31, which are substantially the same area and configuration as sides 16 and 17 respectively, are mounted adjacent respective sides 16 and 17 of the structure 10 by spacers such as 32. The circuit boards 30 and 31 are similar to each other, and are preferably etched on low loss printed circuit boards of a convenient structural thickness. The boards 30 and 31 which have a plane outer face 33 and 34 respectively, are attached such that the surfaces 33 and 34 are in a plane that is substantially parallel to the paths 15 of the reflected waves and the E-field of such waves. Also, the structure 21 has similar circuit board structures referred to at 35 and 36 that are shown mounted adjacent the sidewalls 23 and 24 thereof such that its outer surface 37 and 38 respectively are in a plane parallel to the path 15 and the E-field of the reflected waves. The spacers 32 secure the boards 30 and 31 to their respective sides a selected distance from the sidewalls 16 and 17 of the structure. The boards such as 30 and 31 or 35 and 36 are not mounted on either the top or bottom surfaces 19, 20 of the feedhorn structure 11 or corresponding surfaces of the structure 21 because such surfaces are parallel to the H field.

Referring to FIG. 3, an enlarged isometric view of the structure 10 with one of the boards 31 mounted therein in accordance with the present invention to illustrate a typical arrangement of such structure 31 assembled adjacent the sidewall 16 to be substantially coextensive in area and configuration therewith. A distance between the wall 16, 17 of the feed structure 10 and the surface 34 of the plates 30, 31, respectively, is approximately $\frac{1}{4}$ of a wavelength. The orientation of the board 31 is illustrated such that the plane of its face or the outer surface 34 and consequently spaced conductive portion 35 is parallel to the reflected path 15 and the E-field with the H-field perpendicular thereto.

The boards 30 and 31 may be conventional low loss printed circuit boards that are made of dielectric material and etched to expose the spaced conductive portions 35 as shown in FIG. 3. The conductive portions 35 of FIG. 3, which are shown employed in FIG. 4, are all of similar size and spaced in rows and columns a selected distance apart. In FIGS. 3 and 4, the conductive portions 35 are substantially square. Each one of the squared conductive portions has a perimeter of approximately $\frac{1}{2}$ a wavelength and are approximately $\frac{3}{8}$ of a wavelength apart measured from center to center in both staggered rows and columns. In the embodiment of FIGS. 3 and 4, each one of the squares 35 has a side that is approximately $\frac{1}{8}$ of a wavelength.

Referring to FIG. 5, an alternate embodiment of a circuit board 36 is shown fragmentarily having exposed spaced conductive regions 37 which are substantially circular in configuration. These exposed spaced conductive circles are each $\frac{3}{8}$ of a wavelength apart center to center when measured either in a column or a row on the board. Each of the rows as defined by a straight line extending through the center of each of the conductive circles 37; and each of the columns as defined by a straight line extending through the centers of each conductive circle 37 perpendicular to said first straight line are approximately $\frac{3}{8}$ of a wavelength apart. The boards containing etched squares or circles may be used.

Figure 6:
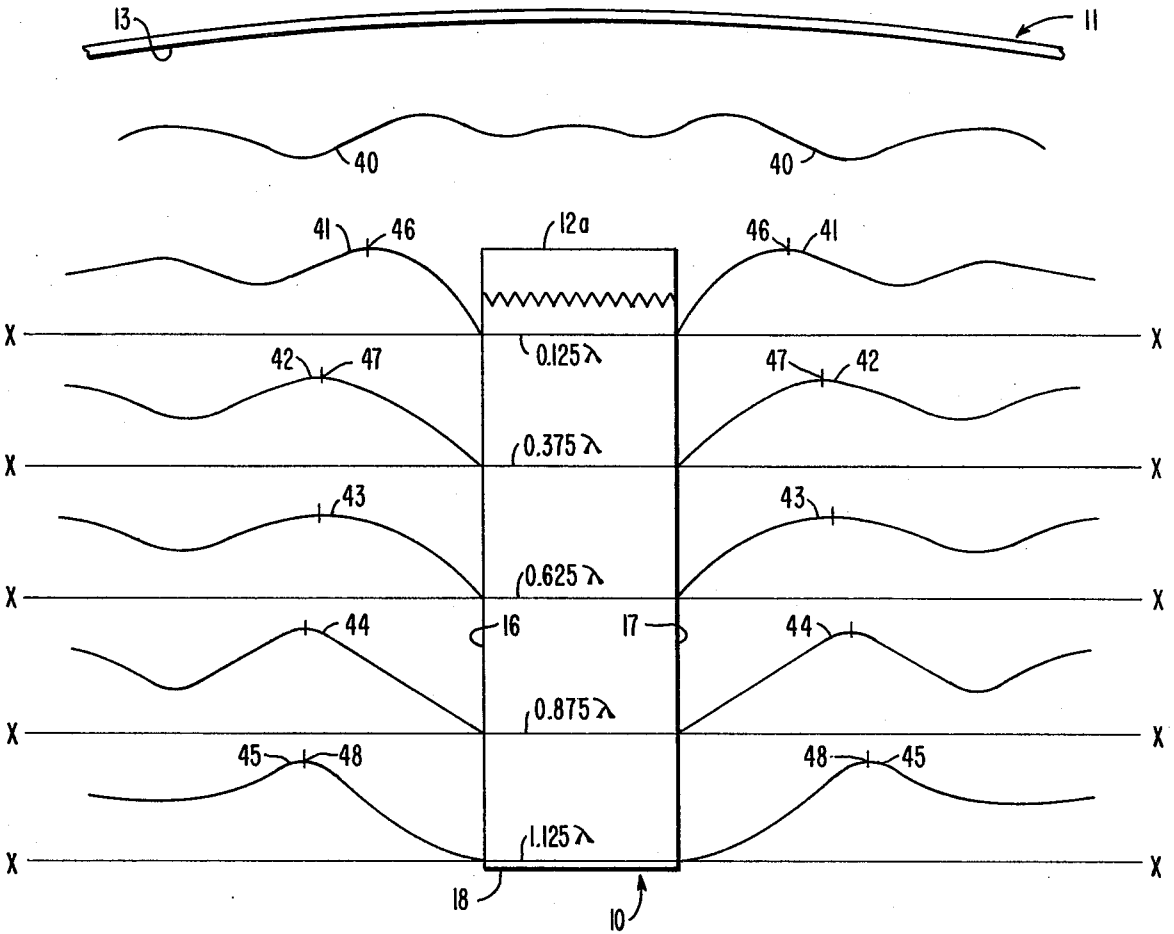
FIG. 6 is a graphical representation of the amplitude of reflected waveforms without the benefit of the present invention.

Referring to FIG. 6, a blocking structure such as the feedhorn structure 10 is shown diagrammatically to illustrate the amplitude of the E-field of the reflected waves without the benefit of the mounting structure of the present invention. The depth of the blocking structure 10 is shown in wavelengths commencing from the feedhorn aperture 12*a* and extending rearwardly in fractions of wavelengths to the rear surface 18, which is approximately 1.125 wavelengths from the transmission point at the aperture 12*a*. The E-field of the reflected wave energy is represented by curves 40 through 45 consecutively beginning close to the reflective surface 13 of the parabolic reflector and extending rearwardly to the complete depth of the structure 10 near its rear surface 18. Straight parallel lines X represent zero amplitude. The line or waveform 40 represents incident and reflected E-field energy in front of the feedhorn structure 10. Curve 41 illustrates the amplitude of the E-field approximately 0.125 wavelengths from the forward surface 12 and shows that at such a slight depth, the blockage is such that the amplitude is at a substantially maximum at point 46 of the waveform 41. As the reflected waves travel along the depth of the feedhorn structure 10, the amplitude or strength of E-field builds up to maximum at points that are increasingly more distant from the sidewalls 16 and 17 respectively. For example, at a depth of 3.75 wavelengths the full E-field strength is at point 47; and at the full depth of the blocking structure 10, maximum E-field strength is not attained until point 48 of the waveform 45. Thus, it is seen that the effective blocking area increases as the depth of the blocking structure such as 10 increases. In other words, the E-field along the structure 10 falls away from such structure as a function of the depth. The increase in blockage width is shown by the points 47 of the E-field rise on either side of the structure 10, which results in the effective blockage width increase on the resulting antennae pattern.

Figure 7:
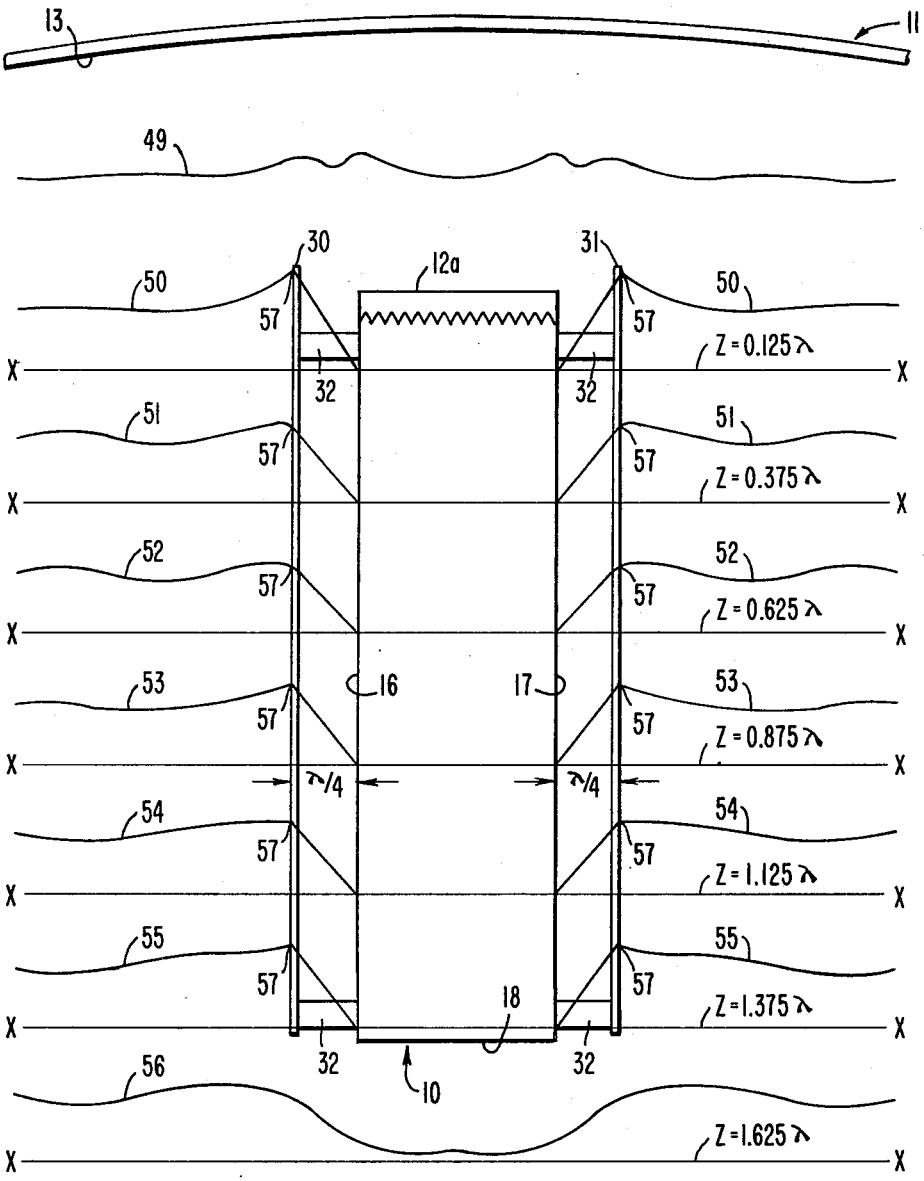
FIG. 7 is a graphical representation of the amplitude of reflected waveforms with the benefit of the present invention.

Referring to FIG. 7, a blocking structure such as the feedhorn structure 10 is shown diagrammatically with the etched circuit boards such as the type 30, 31, or the type 36, fastened at opposite sides thereof in accordance with the present invention such that the surfaces, conductive portions 35 or 37 are in a plane parallel to the path of the reflected waves. Waveform 49 illustrates the incident and reflected E-field between the reflecting surface 13 of the reflector 11 and the forward or opposing surface 12*a* of the feedhorn structure 10. Waveforms 50 through 56 consecutively illustrate the strength or amplitude of the E-field as the reflected waveforms travel along the sidewalls throughout the depth of the structure 10 from a distance of zero wavelengths at the surface 12*a* to a distance of 1.625 wavelengths beyond the depth of the structure 11. Straight parallel lines X represent zero amplitude of the E-field. As shown in FIG. 7, the E-fields rise to full strength a distance of approximately $\frac{1}{4}$ wavelength from the sides 16 and 17, as shown by point 57 of each of the respective waveforms 50 through 55 and maintain their full strength for the complete depth of the feed structure 10. The waveform 56 illustrates the E-field strength beyond the feed structure 10. In summary, the effective blockage width of the structure such as 10 or 21 (FIG. 1) is reduced to approximately a $\frac{1}{4}$ wavelength greater than the actual feed width; or in other words, that distance between the plates 16 and 17, or 23 and 24 of structure 11 or 21 respectively in the dimension of the structure in which the E-field is tangent to the feed walls, regardless of the depth of the blocking structure. Although the capacitive loading structure 30, 31 35, or 36 is described as being suspended about $\frac{1}{4}$ wavelength from the conducting walls 16, 17, 23 and 24; and causes the E-field of the reflected wave energy to reach full strength or amplitude at the outer surface of such loading structure, the loading structure can actually be closer to the conducting wall if required for absolute minimum blockage at the expense of bandwidth. As previously described, the E-field tangent to the feed surface 19, nulls at the surface 19 as the wave front strikes the feed along the path 15; and as it propagates past or around te feed structure 10, or any other blocking structure it spreads with feed depth. The circuit board such as 30 or 31 are referred to as capacitive loading circuits because the conductive regions such as 35 (FIG. 4) or 37 (FIG. 5) load the space in the plane in which they lie with a capacitive reactance.

In actual practice, there can be many feedhorns such as 12 that are aligned along the forward surface 12*a* of the structure 11 which would cause different angles of incidence of the reflected waves. The utilization of substantially square or circular conductive portions 35 and 37 substantially spaced as shown provide an effective assembly regardless of the angle of incidence of the reflected waves. With the benefit of the present invention a marked improvement is seen in the sidelobes such as 1 to 2 dB close to the main beam and 4 to 5 dB far off the axis. Although the present invention is preferred for use with the parabolic cylinder type reflector, which is completely blocked in the elevation plane, such assembly is also beneficial for other types of reflectors. In conclusion from the foregoing description, it has been shown that there has been provided an assembly which reduces feed blockage to approximately $\frac{1}{4}$ of a wavelength greater than the actual width of the blocking structure, regardless of its depth and regardless of the angle of incidence of the reflected waves.

What we claim is:

1. An antennae reflector assembly having a surface for reflecting transmitted wave energy in a predetermined direction, comprising:

at least one aperture blocking structure with a frontal area facing the reflecting surface and sidewalls having a surface area substantially parallel to both the direction and E-field of the reflected wave energy, a board of insulating material having a plane surface for each of the sidewalls, each of said boards being substantially similar to its respective sidewall in both area and configuration and having a plurality of spaced conductive portions disposed on its plane surface, each said spaced conductive portions being configured such that any two perpendicular lines dividing such portion into quadrants are of substantially equal length, and means mounting each of said boards spaced substantially uniformly a predetermined distance from its reflected sidewall.

2. An assembly according to claim 1 wherein the center of each of the spaced conductive portions in one direction are substantially $\frac{3}{8}$ of a wavelength apart.

3. An assembly according to claim 2 wherein the center of each of the spaced conductive portions in a direction perpendicular to said one direction are substantially $\frac{3}{8}$ of a wavelength apart.

4. An assembly according to claim 1 or 2 or 3 wherein each of the conductive portions are substantially square in configuration.

5. An assembly according to claim 1 or 2 or 3 wherein each of the conductive portions are substantially circular in configuration.

6. An assembly according to claim 1 or 2 or 3 wherein the perimeter of each of the conductive portions is substantially $\frac{1}{2}$ a wavelength of the reflected energy.

7. An assembly according to claim 1 or 2 or 3 wherein the board member and its conductive portions is an etched circuit board.

8. An assembly according to claim 1 or 2 or 3 wherein each plane surface of the board is spaced substantially $\frac{1}{4}$ of a wavelength from its respective sidewall.

9. An etched circuit board arrangement for reducing the effect of aperture blockage of reflected wave energy of a predetermined wavelength, comprising an insulative board having a planar surface, a plurality of spaced conductive portions exposed on said planar surface, each said conductive portions having a configuration such that two perpendicular lines dividing such portion into quadrants are of equal length, said conductive portions having a center to center spacing in one direction on the board $\frac{3}{8}$ of the predetermined wavelength and have center to center spacing in a direction perpendicular to said one direction $\frac{3}{8}$ of the predetermined wavelength, said conductive portions having a perimeter substantially $\frac{1}{2}$ of the predetermined wavelength.

10. An etched circuit board according to claim 9 wherein each of the spaced conductive portions are substantially square.

11. An etched circuit board according to claim 9 wherein each of the spaced conductive portions are substantially circular.

* * * * *